US006065389A

United States Patent [19]

Riedlinger

[11] Patent Number: 6,065,389

[45] Date of Patent: May 23, 2000

[54] DIAPHRAGM PUMP

[75] Inventor: Heinz Riedlinger, Bremen, Germany

[73] Assignee: KNF Neuberger GmbH, Freiburg, Germany

[21] Appl. No.: 09/257,901

[22] Filed: Feb. 25, 1999

Related U.S. Application Data

[63] Continuation of application No. PCT/EP97/03941, Jul. 22, 1997.

[30] Foreign Application Priority Data

Aug. 29, 1996 [DE] Germany ..... 196 34 922.2

[51] Int. Cl.[7] ..... F01B 19/02; F16J 3/02

[52] U.S. Cl. ..... 92/99

[58] Field of Search ..... 92/99

[56] References Cited

U.S. PATENT DOCUMENTS

| | | | |
|---|---|---|---|
| 2,287,627 | 6/1942 | Malsbary et al. | 92/99 |
| 2,641,283 | 6/1953 | Houston . | |
| 3,203,186 | 8/1965 | Sheppard | 92/99 |

FOREIGN PATENT DOCUMENTS

| | | |
|---|---|---|
| 1 564 867 | 4/1969 | France . |
| 33 11 104 A1 | 9/1984 | Germany . |
| 295 05 021 | 6/1995 | Germany . |

*Primary Examiner*—F. Daniel Lopez

*Attorney, Agent, or Firm*—Akin, Gump, Strauss, Hauer & Feld, L.L.P.

[57] ABSTRACT

A diaphragm pump, especially a microdiaphragm pump, with a crank drive (1) having a connecting rod (2) and an elastic diaphragm (3) connected with the connecting rod (2) has on the back side of the diaphragm facing away from the compression chamber at least one undercut fastening opening (8) for insertion of the complementarily formed attachment end of the connecting rod. In order to be able to fix the diaphragm (3) so precisely on the connecting rod (2) that radial as well as axial forces do not move it from its position relative to the connecting rod (2), and in order that the diaphragm (3) is exposed to as little additional flexing work as possible, the connecting rod (2) is provided on its attachment end with a support surface (4) for underside support of the central diaphragm area having a bearing surface (5). One or more fastening projections (6) projecting beyond the support surface (4) of the connecting rod (2) in the axial direction of the connecting rod (2) are provided for form-locking engagement in the central diaphragm area having at least one fastening opening (8).

8 Claims, 2 Drawing Sheets

DIAPHRAGM PUMP

CROSS-REFERENCE TO RELATED APPLICATION

This is a continuation of International Application PCT/EP97/03941, filed Jul. 22, 1997, the disclosure of which is incorporated herein by reference

BACKGROUND OF THE INVENTION

The invention concerns a diaphragm pump with a crank drive having a connecting rod and an elastic diaphragm connected to the connecting rod, which diaphragm has an undercut fastening opening on its back side facing away from the compression chamber for inserting the complementarily formed attachment end of the connecting rod, wherein the connecting rod has a support surface on its attachment end for underside support of the central diaphragm area having a bearing surface, and wherein at least one fastening projection projecting in the axial direction of the connecting rod is provided on the support surface of the connecting rod for form-locking engagement in a central diaphragm area having at least one fastening opening.

Diaphragm pumps are also used, for example, as microdiaphragm pumps in connection with portable analysis devices. Since these analysis devices and their microdiaphragm pumps are usually operated independently of the power network by batteries or storage cells, motors with a low current consumption are necessary for this. Such motors have, however, only a limited performance capacity, for which reason the flexing work of the diaphragm should be reduced during operation of these previously known diaphragm pumps. With weak motors of this type the diaphragm must therefore also be configured sufficiently thin, but should—especially in connection with analysis devices—nevertheless be very tight, in order not to impair the accuracy of these devices.

Microdiaphragm pumps are already known, whose diaphragm is held between a metal thrust washer facing the compression chamber and the connecting rod head, wherein the thrust washer is attached to the connecting rod head by means of a screw connection, which passes through a central fastening opening in the diaphragm. Such a thrust washer clamp has, however, a central inelastic area of the diaphragm as a consequence, whereby the stroke volume is reduced, and the output of the previously known microdiaphragm pump is restricted.

One has thus also created a microdiaphragm pump, in which the diaphragm with its peripheral edge area clamped in the pump head form-lockingly encloses a connecting rod head with an approximately T-shaped cross section. Through this form-locking connection of the diaphragm on the connecting rod head, the previously mentioned thrust washer clamping of the diaphragm can be dispensed with. This previously known microdiaphragm pump has a greater stroke volume, since the diaphragm is also elastic in its central area. During operation of the previously known microdiaphragm pump, the diaphragm moves back and forth on the connecting rod head surrounded by it, which is associated with an additional flexing work activity of the diaphragm.

From DE 33 11 104 A1 a diaphragm pump of the type mentioned at the beginning is already known, whose diaphragm has an undercut fastening opening on the diaphragm underside facing away from the compression chamber. This fastening opening is connected with the complementarily formed attachment end of a connecting rod. On the attachment end of the connecting rod a fastening projection is provided for this, which is molded into the fastening opening. The fastening projection extends beyond a support surface situated on the attachment end of the connecting rod, which serves for underside support of a central diaphragm area having a bearing surface. Since the fastening projection is vulcanized into the diaphragm, and since the diaphragm of this previously known diaphragm pump has a central area increasingly thickened toward the center, the diaphragm, which is consequently flexibly configured only in its outer annular zone, can only be deformed with a correspondingly heavy flexing work. Such a diaphragm is therefore advantageously usable principally in larger diaphragm pumps with a high capacity pump drive, but less well suited for microdiaphragm pumps, whose motors have only a low performance capacity.

SUMMARY OF THE INVENTION

There thus exists in particular the object of creating a diaphragm pump of the type mentioned at the beginning, whose diaphragm can be fastened on the connecting rod head in a simple manner but so precisely that no additional flexing work occurs during operation.

With the diaphragm pump of the type mentioned at the beginning, the accomplishment of this object according to the invention consists in particular in that on the diaphragm underside at least one peg-shaped insert element is provided, and that in assembled position the insert element lies laterally against the one fastening projection or against several fastening projections of the connecting rod.

With the diaphragm pump of the invention the connecting rod has a supporting surface, which supports a central diaphragm area having a bearing surface. This cannot move back and forth on the connecting rod during operation owing to the diaphragm supported on its diaphragm underside, whererby undesirable additional flexing work of the diaphragm is avoided. In particular, a support ring with larger dimensions exerts, moreover, an influence on the possible conveying output of the diaphragm, because this namely creates a larger piston-like zone, especially in connection with a larger diameter of the support ring, which is not deformed during the upward and downward stroke and consequently leads to a greater stroke volume. This configuration of the diaphragm permits a relatively small, fixed diameter of the connecting rod, so that comparatively large elastic zones are formed, which lead to low tensions in the diaphragm, and thereby to a greater stroke in relation to the effective diameter of the diaphragm. The diaphragm is therefore distinguished by better diaphragm stretching conditions and its constantly uniform trouble-free seat Since the diaphragm of the diaphragm pump of the invention no longer needs any central fastening opening, this diaphragm is very tight at its connecting rod attachment in contrast to the previously known thrust washer clamping.

The peg-shaped insert of the diaphragm in accordance with the invention, preferably lying against an annular fastening projection or against at least three approximately uniformly spaced apart fastening projections, undertakes the centering and guidance of the diaphragm during the oscillation movements. At the same time, this peg-shaped insert assumes the radial and axial guidance of the diaphragm relative to the connecting rod. The diaphragm is thereby so precisely fixed on the connecting rod, that radial as well as axial forces do not move it from its position relative to the connecting rod.

For this purpose, an embodiment is preferred, in which an annular projection arranged on a circle concentric to the longitudinal axis of the connecting rod, is provided with a hook-shaped, laterally-projecting reaching-behind edge on its free end region. Such a fastening projection on the connecting rod promotes the good centering and guidance of the diaphragm during its oscillation movements; at the same time, the diaphragm is especially precisely fixed on the connecting rod.

It is also possible, however, that several, preferably at least three fastening projections are provided, arranged on a circle concentric to the longitudinal axis of the connecting rod.

An especially advantageous embodiment in accordance with the invention provides that the supporting surface situated at the attachment end of the connecting rod for underside support of the central diaphragm area having a bearing surface has a supporting collar extending approximately radially beyond the cross section of the connecting rod, and that the central bearing surface of the diaphragm is dimensioned corresponding to this enlarged supporting surface. The appropriately dimensioned diaphragm transfers through it central bearing surface a portion of the compressive forces to the support collar extending approximately radially beyond the cross section of the connecting rod.

In order to promote good centering of the diaphragm on the attachment end of the connecting rod, it is expedient if a preferably central centering projection is provided on the supporting surface of the connecting rod for engaging in a matching recess of the diaphragm.

In order to be able to configure the diaphragm elastically over as large a radial area as possible, and in order to influence positively the possible conveying output of the diaphragm, it is advantageous if the side of the member facing the compression chamber of the pump is free of attachment fittings.

In order to attain a good seal on the connecting rod attachment, it is expedient if the diaphragm facing the compression chamber is constructed as completely closed.

In accordance with a preferred embodiment, it is provided that the diaphragm pump of the invention is constructed as a microdiaphragm pump.

The individual features can be realized each by itself or several together in an embodiment in accordance with the invention.

BRIEF DESCRIPTION OF THE DRAWING

The foregoing summary, as well as the following detailed description of the invention, will be better understood when read in conjunction with the appended drawings. For the purpose of illustrating the invention, there are shown in the drawings embodiment(s) which are presently preferred. It should be understood, however, that the invention is not limited to the precise arrangements and instrumentalities shown. In the drawings.

DETAILED DESCRIPTION OF THE INVENTION

Figure 1:
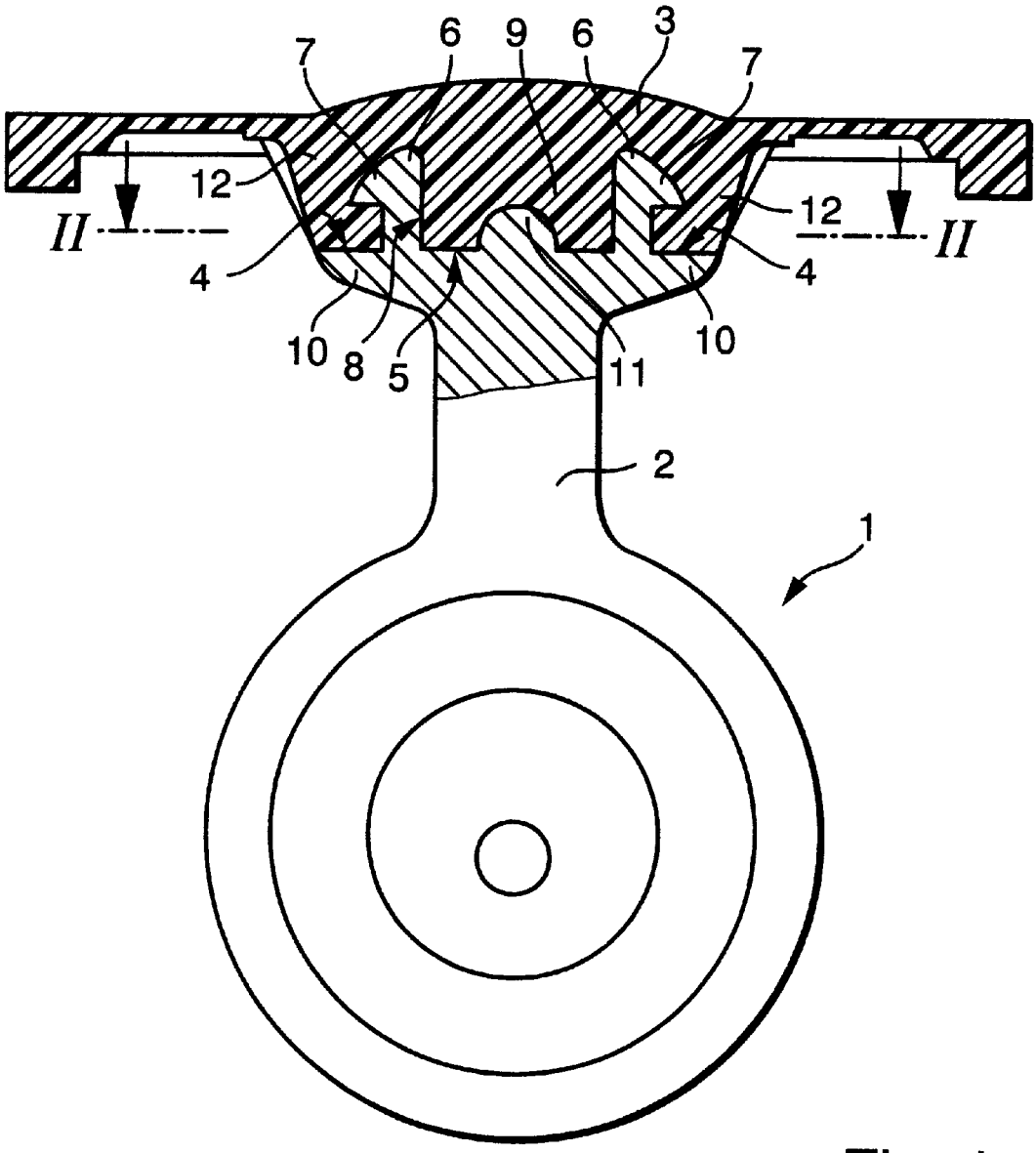
FIG. 1 is a schematic representation, partially in cross-section, of a crank drive, connecting rod and diaphragm according to the invention.

FIG. 1 depicts in schematic representation the crank drive 1 as well as a diaphragm 3 of a diaphragm pump connected with a connecting rod 2 of the crank drive 1. The connecting rod 2 of the crank drive 1 is connected with the diaphragm 3 in such a way that the diaphragm is moved back and forth above the connecting rod 2 during the operation of the diaphragm pump.

Figure 2:
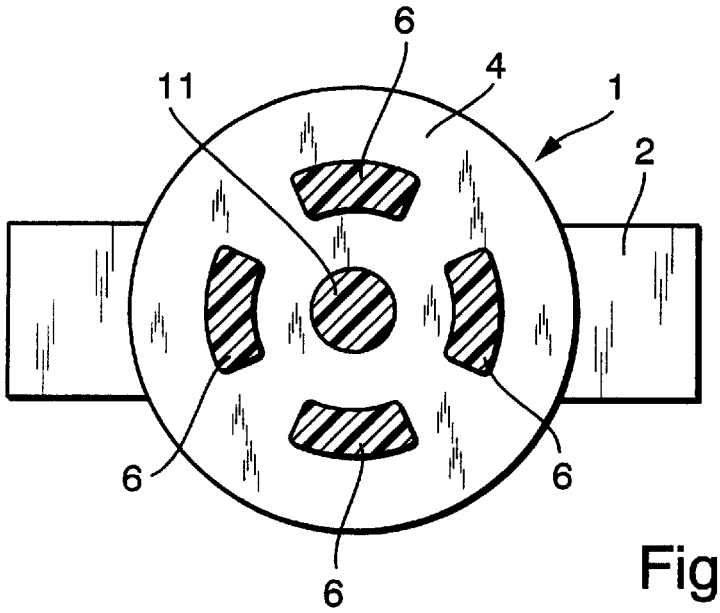
FIG. 2 is a cross-sectional view taken along line 2—2 in FIG. 1 showing the top of the connecting rod.
Figure 3:
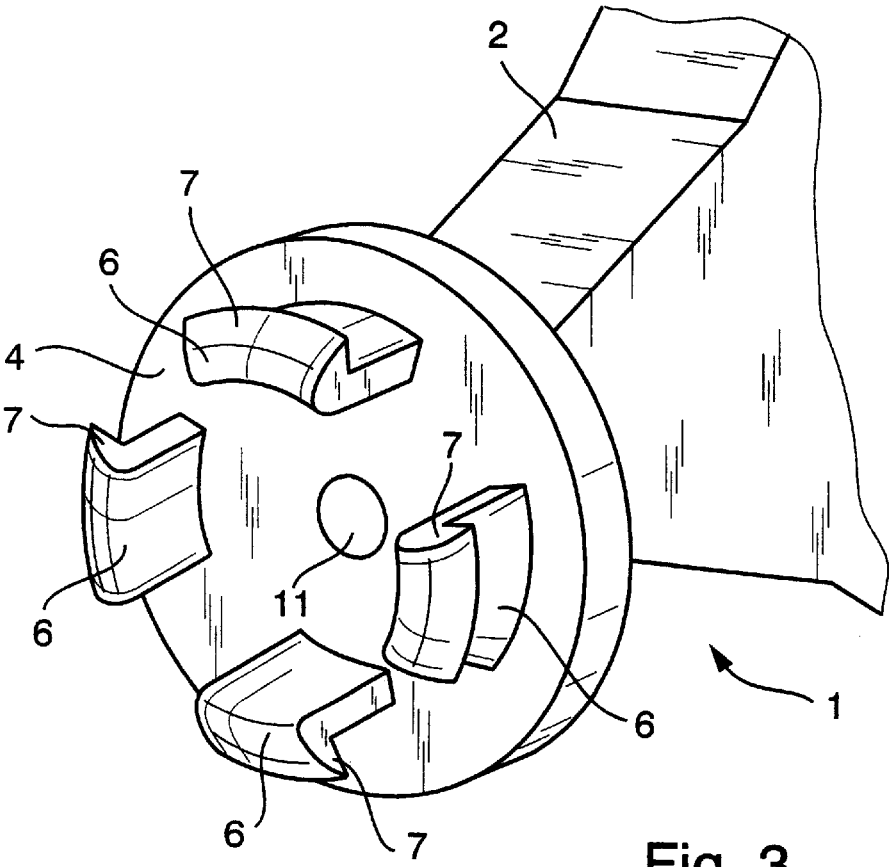
FIG. 3 is a perspective view of the top of the connecting rod showing the fastening projections.

As shown in FIGS. 1–3 connecting rod 2 has on its attachment end facing the diaphragm 3 a support surface 4 for underside support of the central diaphragm area having a bearing surface 5. Above the support surface 4 of the connecting rod 2 projects an annular fastening projection 6, arranged concentrically to the longitudinal axis of the connecting rod, which has a hook-shaped, reaching-behind rim 7 projecting laterally outwardly on its free end region. The fastening projection 6, projecting in the axial direction of the connecting rod 2, form-lockingly engages into a fastening opening 8, constructed as an annular groove and correspondingly hook-shape configured in its thin cross section, on the underside of the diaphragm.

This annular fastening opening 8 circumscribes a peg-shaped insert 9 on the diaphragm underside which, in the single figure, lies against the inner peripheral edge of the annular fastening projection 6.

The support surface 4 provided on the connecting rod 2 supports the central diaphragm area of the diaphragm 3 having the bearing surface 5. Owing to the diaphragm 3 being supported on its diaphragm underside, this can no longer move back and forth on the connecting rod while the diaphragm pump is operating, whereby an undesirable additional flexing work by the diaphragm 3 is avoided. In particular, a larger dimensioned supporting surface exerts, moreover, an influence on the possible conveying output of the diaphragm 3, because this namely creates a larger piston-like zone, particularly with a larger diameter of the support surface 4, which is not deformed during the upward and downward movement, and consequently leads to a greater stroke volume. At the same time, this construction permits a relatively small fixed diameter of the connecting rod 2, so that comparatively large elastic zones are formed from it, which lead to lower tensions in the diaphragm 3 and thereby to a greater stroke in relation to the effective diameter of the diaphragm 3. The diaphragm 3 is therefore distinguished by better diaphragm stretching conditions and its constantly uniform problem-free seat. Since the diaphragm 3 of the diaphragm pump represented here no longer has a central fastening opening, this diaphragm 3 is very tight on the connecting rod attachment in contrast to the previously known thrust washer clamp.

It is clear from the sole figure that the support surface 4 situated at the attachment end of the connecting rod 2 has a support collar 10 extending somewhat radially beyond the cross section of the connecting rod for the underside support of the central diaphragm area having a bearing surface 5, whereby the central bearing surface 5 on the diaphragm 3 is dimensioned corresponding to this enlarged support surface 4. The diaphragm 3 has for this a support ring 12, which circumscribes the fastening opening 8 between itself and the peg-shaped insert 9.

The peg-shaped insert 9 assumes the centering and guidance of the diaphragm during its oscillations. In this way, the central insert 9 promotes, in addition, the radial and axial guidance of the diaphragm 3 in relation to the connecting rod 2.

In the center of the fastening projection 6, approximately coaxial to the longitudinal axis of the connecting rod, a central centering projection 11 can be provided on the support surface 4 of the connecting rod 2, which engages a matching recess of the diaphragm 3. Through this centering projection 11 good centering and guidance of the diaphragm 3 during the oscillating movement is still further promoted. Through the measures described above, the diaphragm 3 is so precisely fixed on the connecting rod 2, that radial as well as axial forces do not move it out of its position in relation to the connecting rod.

Since the diaphragm 3 can be mounted sufficiently firmly on the attachment end of the connecting rod 2, the side of the diaphragm 3 facing the compression chamber of the pump can be constructed free of fastening fittings. In order thereby to attain a good tightness at the connecting rod attachment, it is advantageous if the diaphragm facing the compression chamber is constructed as thoroughly closed.

The diaphragm 3 is consequently distinguished by a good tightness at the connecting rod attachment. Herein, the diaphragm can be constructed as a flat diaphragm as well as a structured or shaped diaphragm. By configuring the diaphragm 3 as a shaped diaphragm, smaller harmful spaces and thereby better tightness conditions can be attained.

Since with the here only schematically-represented diaphragm pump a thrust washer clamping is not necessary, better diaphragm stretching conditions can be attained. Since the peg-shaped insert 9 engages the recess bounded by the fastening projection 6 at the attachment end of the connecting rod 2, and since the fastening projection 6, which is lockable in the fastening opening 8, practically takes care of a self-centering of the diaphragm 3, a costly alignment of the diaphragm 3 during assembly can be dispensed with. The diaphragm 3 is, however, distinguished by a constantly uniform trouble-free seat.

It will be appreciated by those skilled in the art that changes could be made to the embodiment(s) described above without departing from the broad inventive concept thereof. It is understood, therefore, that this invention is not limited to the particular embodiment(s) disclosed, but it is intended to cover modifications within the spirit and scope of the present invention as defined by the appended claims.

I claim:

1. A diaphragm pump comprising a crank drive (1) having a connecting rod (2) and an elastic diaphragm (3) connected with the connecting rod (2), the diaphragm (3) having on its back side facing away from a compression chamber at least one fastening opening (8) in a central diaphragm area, the connecting rod (2) having a support surface (4) for underside support of the central diaphragm area having a bearing surface (5), wherein a plurality of fastening projections (6) are provided projecting beyond the support surface (4) of the connecting rod approximately in an axial direction of the connecting rod for form-locking engagement with the at least one fastening opening, the plurality of fastening projections being arranged on a circle concentric to a longitudinal axis of the connecting rod, and wherein at least one peg-shaped insert (9) is provided on the back side of the diaphragm, the insert (9) in an assembled position lying laterally against the at least one fastening projection (6) of the connecting rod.

2. The diaphragm pump according to claim 1, wherein the diaphragm (3) facing the compression chamber is constructed as completely closed.

3. The diaphragm pump according to claim 1, wherein the pump is a microdiaphragm pump.

4. The diaphragm pump according to claim 1, wherein the support surface (4) includes a support collar (10) extending approximately radially beyond a cross section of the connecting rod (2), and the bearing surface (5) of the diaphragm (3) is dimensioned corresponding to the support collar.

5. The diaphragm pump according to claim 1, wherein a centering projection (11) is provided on the support surface (4) for engaging in a matching recess of the diaphragm (3).

6. The diaphragm pump according to claim 5, wherein the centering projection (11) is located centrally on the support surface (4).

7. The diaphragm pump according to claim 1, wherein a side of the diaphragm (3) facing the compression chamber of the pump is free of fastening fittings.

8. A diaphragm pump comprising a crank drive (1) having a connecting rod (2) and an elastic diaphragm (3) connected with the connecting rod (2), the diaphragm (3) having on its back side facing away from a compression chamber at least one fastening opening (8) in a central diaphragm area, the connecting rod (2) having a support surface (4) for underside support of the central diaphragm area having a bearing surface (5), the support surface (4) includes a support collar (10) extending approximately radially beyond a cross section of the connecting rod (2), and the bearing surface (5) of the diaphragm (3) is dimensioned corresponding to the support collar, wherein an annular fastening projection (6) is provided projecting beyond the support surface (4) of the connecting rod approximately in an axial direction of the connecting rod for form-locking engagement with the at least one fastening opening, the annular fastening projection being arranged on a circle concentric to a longitudinal axis of the connecting rod and having a radially outwardly projecting edge (7) on a free end region, and wherein at least one peg-shaped insert (9) is provided on the back side of the diaphragm, the at least one fastening opening (8) being bordered by an outer support ring (12) on the elastic diaphragm (3) and the insert (9).

* * * * *